US009867450B2

(12) United States Patent
Kotter

(10) Patent No.: US 9,867,450 B2
(45) Date of Patent: Jan. 16, 2018

(54) PORTABLE CHAIR BACKPACK

(71) Applicant: Kenneth Coburn Kotter, Mandeville, LA (US)

(72) Inventor: Kenneth Coburn Kotter, Mandeville, LA (US)

( * ) Notice: Subject to any disclaimer, the term of this patent is extended or adjusted under 35 U.S.C. 154(b) by 7 days.

(21) Appl. No.: 15/221,357

(22) Filed: Jul. 27, 2016

(65) Prior Publication Data

US 2017/0127805 A1 May 11, 2017

Related U.S. Application Data

(60) Provisional application No. 62/198,353, filed on Jul. 29, 2015.

(51) Int. Cl.

| | |
|---|---|
| ***A45F 3/04*** | (2006.01) |
| ***A45F 3/10*** | (2006.01) |
| ***A45F 3/14*** | (2006.01) |

(52) U.S. Cl.

CPC ..... *A45F 3/10* (2013.01); *A45F 3/14* (2013.01); *A45F 3/04* (2013.01); *A45F 2003/144* (2013.01); *A45F 2003/146* (2013.01); *A45F 2200/0566* (2013.01)

(58) Field of Classification Search

CPC ..... A45F 3/04; A45F 3/10; A45F 2200/0566
USPC ..... 224/628, 637, 262, 259, 261, 683, 684, 224/251, 917

See application file for complete search history.

(56) References Cited

U.S. PATENT DOCUMENTS

| | | | | | |
|---|---|---|---|---|---|
| 1,109,161 | A * | 9/1914 | Chindgrin | A45F 3/14 | 217/28 |
| 3,114,486 | A * | 12/1963 | Flexman | A45F 3/08 | 224/148.6 |
| 3,498,511 | A * | 3/1970 | Marg | F41C 33/003 | 224/149 |
| 3,710,997 | A * | 1/1973 | Asikainen | F42B 39/26 | 206/3 |
| 4,449,654 | A * | 5/1984 | Cappis | A45F 3/16 | 224/148.3 |
| 5,297,708 | A * | 3/1994 | Carpenter | A45F 4/02 | 224/155 |
| D354,393 | S * | 1/1995 | Mocca | 224/259 | |
| 5,470,001 | A * | 11/1995 | Konchan | A01K 97/04 | 224/240 |

(Continued)

*Primary Examiner* — Justin Larson

(57) ABSTRACT

Revealed invention relates to a backpack for carrying portable chairs, and/or selected equipment, safely and comfortably on the back of a person. Shoulder harness support straps secure it to the back of an individual and the waist harness support transfer the weight to the hips. People attending sporting events, concerts, picnics, or camping many time have an uncomfortable job of carrying several portable chairs, other selected equipment, and other items slung over one's shoulders for a considerable distance. The bulk and weight of carrying more than one portable chair, and/or selected equipment, becomes a frustrating task. Especially if one has to carry up to five chairs, and/or selected equipment. The Portable Chair Backpack has five designated locations for chairs, and/or selected equipment to be securely and comfortable carried over a long distance. Shoulder harness support straps secure it to the back of an individual. Waist harness support transfers the weight to the hips.

6 Claims, 3 Drawing Sheets

(56) References Cited

U.S. PATENT DOCUMENTS 5,893,504 A * 4/1999 Baronian ..... A45F 3/04 224/627
6,662,981 B2 * 12/2003 McUmber ..... A45F 3/10 224/155
6,843,399 B2 * 1/2005 Garcia ..... F42B 39/02 224/665
6,857,820 B2 * 2/2005 Jacoway ..... B63C 11/02 224/627
6,962,278 B2 * 11/2005 Obatake ..... A45F 5/00 224/250
7,100,810 B1 * 9/2006 Bosch ..... F42B 39/02 224/196
7,644,847 B2 * 1/2010 Howell ..... A45F 3/08 224/628
7,703,645 B2 * 4/2010 Moskun ..... A45F 3/08 224/579
8,540,126 B2 * 9/2013 Kawamoto ..... A45F 5/02 224/149
9,049,916 B2 * 6/2015 Berei ..... A45F 3/04
D768,934 S * 10/2016 Osweiler ..... D28/38
2003/0000974 A1 * 1/2003 McUmber ..... A45F 3/10 224/155
2005/0040199 A1 * 2/2005 Lemens ..... A45F 3/14 224/637
2005/0140103 A1 * 6/2005 Marchant ..... A45C 5/14 280/47.26
2007/0108248 A1 * 5/2007 Hoffmeier ..... A45C 5/06 224/650
2008/0078789 A1 * 4/2008 Fiola ..... A45F 3/08 224/155
2008/0185413 A1 * 8/2008 Marques ..... A45F 5/02 224/674
2010/0314423 A1 * 12/2010 Kawamoto ..... A45F 5/02 224/195
2013/0175310 A1 * 7/2013 Turner ..... A45F 3/04 224/637
2014/0209646 A1 * 7/2014 Hoppa ..... A45F 3/08 224/261
2017/0127805 A1 * 5/2017 Kotter ..... A45F 3/10
2017/0143106 A1 * 5/2017 Kotter ..... A45F 3/08

* cited by examiner

PORTABLE CHAIR BACKPACK

CROSS REFERENCES CITED

U.S. Patent Documents

U.S. Pat. No. 3,266,686 August 1966 Griffith
U.S. Pat. No. 4,022,292 May 1977 Van Gompel
U.S. Pat. No. 5,409,291 April 1995 Lamb and Mora
U.S. Pat. No. 5,465,887 November 1995 Hudson
U.S. Pat. No. 5,597,101 January 1997 Barber
U.S. Pat. No. 5,957,349 September 1999 Drulik
U.S. Pat. No. 5,975,389 November 1999 Braun and Braun
U.S. Pat. No. 6,986,445 January 2006 Stockman
2013/01753310 July 2013 Turner, Turner, Moussent
2014/0209646 July 2014 Hoppa

BACKGROUND OF THE INVENTION

This invention pertains to an apparatus that is capable of simultaneously carrying one to five portable chairs, and/or selected equipment securely and safely. Although, several patents have been found of a backpack chair combination where the backpack converts into a chair or a backpack that carries a metal foldup chair horizontally or where the backpack converts into a hunter's tree stand or another that carries an ice chest and a fold up portable chair on a metal structure frame.

If a person needs to carry one specific chair or a cot these are some examples U.S. Pat. No. 3,266,686 Inventor J. E, Convertible Pack and Chair, U.S. Pat. No. 6,986,445, Inventor James A. Stockman, Backpack and chair apparatus, U.S. Pat. No. 5,409,291, Inventor Timothy Lamb and Albert Mora, Combined chair and backpack, U.S. Pat. No. 5,975,389, Inventor Joel L Braun and Kimberly F Braun, Backpack with extendable sub-frame, U.S. Pat. No. 5,957,349, Inventor Irvin W. Miller, Tent/Cot/backpack structure, A hunter would desire to use the backpack for carrying his weapons as described in these inventions, U.S. Pat. No. 5,465,887, Inventor Keith Hudson, Archery Bow Backpack Carrier, U.S. Pat. No. 4,754,904, Inventor Alan G. Fischer and Edward P. Fitzgerald, Carrier Assembly for Compound Bow or Firearm. Or if a hunter needs a tree stand, U.S. Pat. No. 4,022,292, Inventor James J. Van Gompel, Portable Tree Stand or Crow's Nest.

For the surfer to carry his board and several other things, there is U.S. Pub. No: US 2013/01753310, Backpack for Elongated Items, Inventors Tierre Turner, Camille Turner, Rene Paul Mousseut, or one that will carry the ice chest and a portable chair, U.S. Pub. No: US 2014/0209646, Bulk Item Backpack, Inventor Thomas Hoppa.

BRIEF SUMMARY OF THE INVENTION

The present invention contemplates a new and innovative backpack for carrying portable chairs, and/or selected equipment, safely, and securely.

According to the present invention, the portable chair backpack is designed to carry up to five portable chairs, and/or selected equipment comfortable over a short or long distant.

A patent search of over thousands of patents for a similar invention has revealed the uniqueness of this design. Imagine comfortably carrying all your portable chairs, tent, canopy, baseball bats, in one safe journey with the Portable Chair Backpack. For the camper, one could hike the tent and portable chairs securely and safely through the mountains to the secluded campsite. For example, a group traveling to a festival and someone has the frustrating and difficult task to carry the portable chairs slung over his/her shoulder, possibly walking over a quarter of a mile or more, as the chair bags straps cut into his/her shoulder with every step! However, someone saved the day! He/she bought a Portable Chair Backpack! Now he/she can with ease and comfort carry all of the chairs and/or equipment on the new Portable Chair Backpack.

Each item to be carried has a designated secure location. The three rows of individual Velcro straps and two security straps secures the items to the backpack to avoid mishaps.

DETAILED DESCRIPTION OF THE INVENTION

Figure 1:
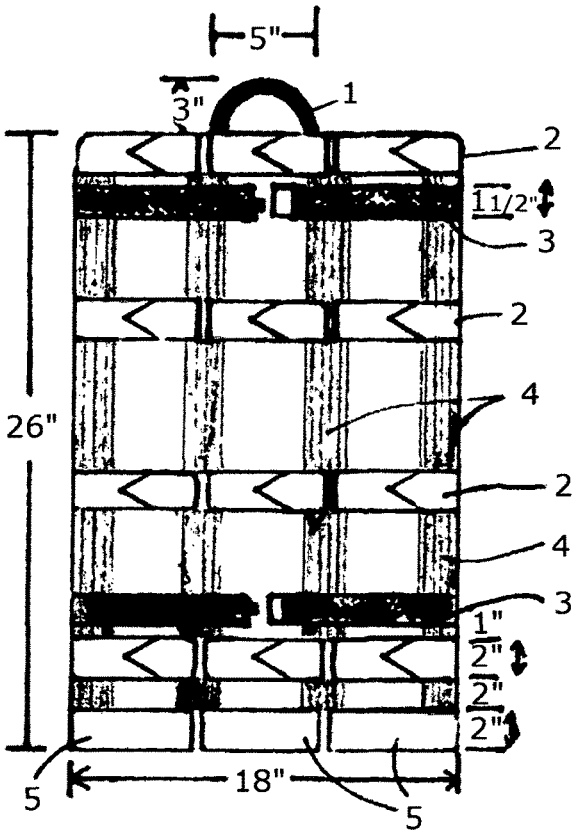
FIG. 1 is the side that faces away from the body. The view is of the Portable Chair Backpack that holds the portable chairs, and/or selected equipment.

FIG. 1 is the side that faces away from the body. The view is of the Backpack that holds the portable chairs, and/or selected equipment. "1" is the handle made out of strap material. "2" is four rows of three independent two inch Velcro straps. Each strap has a right and left side. Both straps are eleven inches in length. The left strap overlaps the right strap securing to each other through the Velcro technology. The backpack holds three chairs, and/or selected equipment, on the row that attaches to the backpack panel. The Velcro straps secures each chair, and/or selected equipment, in place with four Velcro straps. "3" is two, one and half inch wide, four feet long, security straps are set and tightened after the chairs, and/or selected equipment, are Velcro secured. Or after the fourth and fifth chairs, and/or selected equipment, are set in placed then again the security straps are secured and tightened. Therefore, causing the chairs, and/or selected equipment to work as a frame for the backpack. If only three chairs, and/or selected equipment are being transported then again the security strap will be secured and tightened which will work as a frame for the backpack. "4" is the vertical and horizontal straps attached onto the rip stock material. The horizontal strap material is attached under "2", Velcro straps, "3", security straps, and "5", footie pockets. These straps also hold the backpack together and give it strength. "5" is five footie pockets. The footie pockets are two inches deep so the chairs feet, and/or selected equipment will be secure and support the weight of the items.

Figure 2:
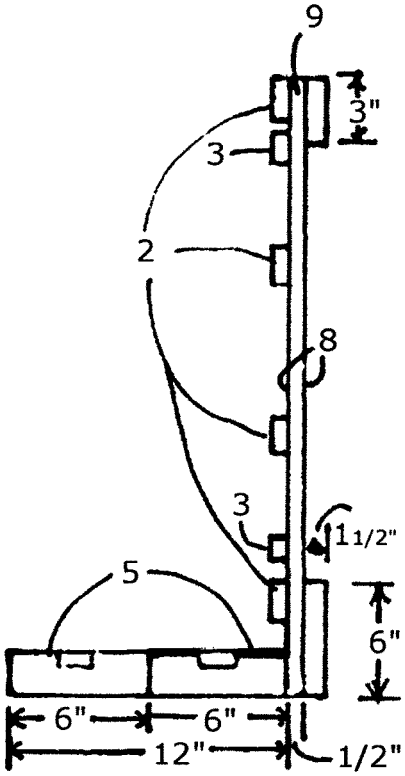
FIG. 2 is the side view of the Backpack.

FIG. 2 is the side view of the Backpack. "6" is the strap material attached in place to support the shoulder harness. "7" is the strap material attached in place to support the waist harness. "8" is the rip stop material attached on all six sides. "9" is the half inch closed cell foam. The foam will give the user comfort from the portable chairs, and/or selected equipment.

Figure 3:
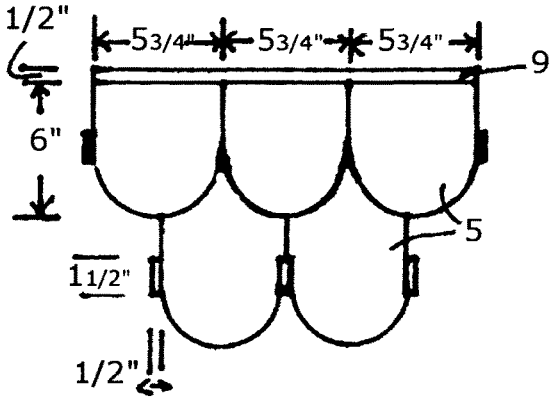
FIG. 3 is a top view of the Backpack.

FIG. 3 is a top view of the backpack. "5" is five footie pockets. "9" is the half inch closed cell foam. "17" is the side footie pocket support strap connector location. "18" is the second level center support strap connector location. "19" is the second level side support strap connector location.

Figure 4:
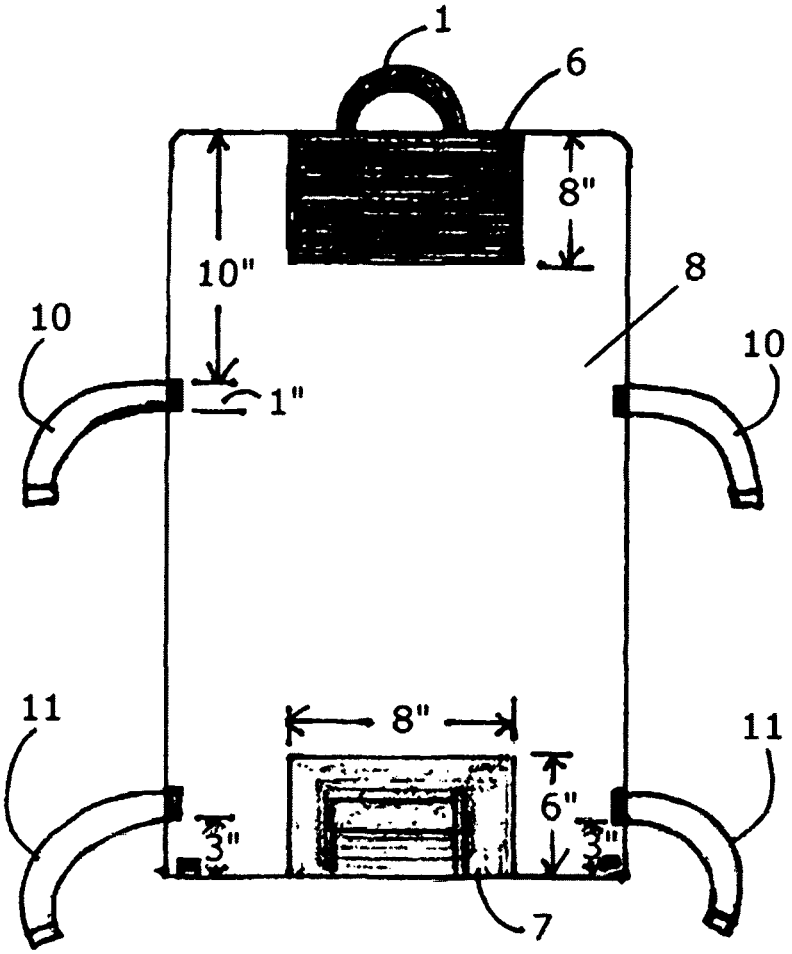
FIG. 4 is the side that faces and attaches to the back of the person carrying the backpack.

FIG. 4 is the side that faces and attaches to the back of the person. "1" is the handle made out of strap material. 6 is the strap material attached in place to support the shoulder harness. "7" is the strap material attached in place to support the waist harness. "8" is the rip stop material attached on all six sides. "10" is the chest controller strap. "11" is the waist controller strap.

Figure 5:
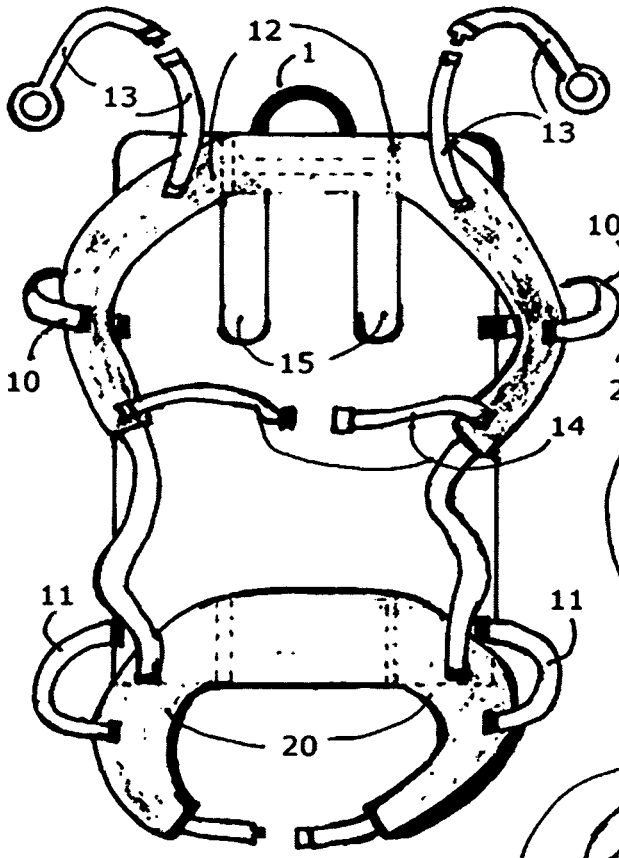
FIG. 5 is the side that faces and attaches to the back of the person carrying the backpack with the shoulder harness, straps, and the waist harness.

FIG. 5 is the side that faces and attaches to the back of the person carrying the backpack with the shoulder harness, straps, and the waist harness. "1" is the handle made out of strap material. "12" is the shoulder harness."13" is the shoulder harness controller strap and eyelet security strap. This controls the shift weight from side to side. One end of the strap is connected to the upper portion of the shoulder harness with a releasable connection fitting located in the center connected to the eyelet security strap which is secured to far right or far left chair, and/or selected equipment located on the first row. "14" is the vertical foam back support pads which gives comfort to the user and gives a space between the backpack and the back of the user. "20" is the waist harness.

Figure 6:
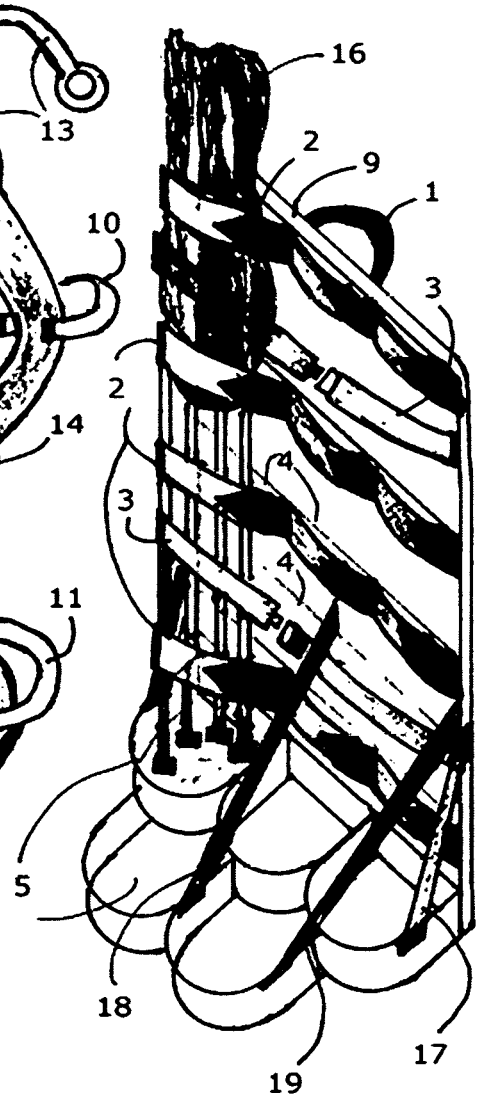
FIG. 6 is the perspective view of the backpack holding a strapped in folded portable chair.

FIG. 6 is the perspective view of the backpack holding a strapped in portable chair. "1" is the handle made out of strap material. "2" is four rows of three independent pair of two-inch-wide Velcro straps attached onto the backpack. The loose ends of the straps wrap over the chair, with one end of the strap overlaying the opposing strap being secured with Velcro technology. "3" is two, one and half inch wide four feet long security strap with a releasable connection fitting in the center of the strap. The security straps hold the fourth and fifth chair, and/or selected equipment in place therefore causing the chairs and/or selected equipment to work as a frame for the Backpack. "16" is the folded portable chair Velcro in place. "5" is five footie pockets. "4" The horizontal straps are attached onto the rip stock material. The horizontal strap material is attached under "2", "3", and "5". "17" is the side footie pocket support strap. "18" is the fourth and fifth footie pocket center support strap. The strap has a releasable connection fitting. One side of the strap is connected to the backpack and the other end is connected to the footie pocket. The strap is passed through or around the legs of the chair, and/or selected equipment connects with the footie pocket. "19" is the fourth and fifth footie pocket side support strap. The strap has a releasable connection fitting. The strap is passed through or around the legs of the chair, and/or selected equipment and connect with the footie pocket support strap. One side of the strap is connected to the backpack and the other end is connected to the footie pocket with a releasable connection fitting in the center.

From the foregoing, it may be seen that the backpack of the present representation is considered illustration or illustrations only of the principles of the invention and may not be drawn to scale and not meant to limit the scope of the invention. Further, since certain changes and modifications such as size, materials, shape, form, function and manner of operation, assembly and use to those skilled in art, the invention shall not be limited to the exact constraints and operation shown and described. Accordingly, all suitable moderations and equivalents may be implemented, falling within the scope of the said invention. Therefore, various changes can be made in the function and assembly of the elements of the said invention—Portable Chair Backpack, without departing from the scope as set forth in the appended claims and the legal equivalents thereof.

The invention claimed is:

1. A backpack for transporting portable chairs and/or selected equipment securely and safely, comprising:

a foam back plate (9) with a top, bottom, left side, right side, front face, and back face;

a first set of straps (2) arranged in multiple horizontal rows along the foam back plate attached to the left and right sides of the foam back plate as well as one or more points between the left and right sides of the foam back plate, the first set of straps configured to hold chairs and/or other selected equipment against the foam back plate;

a second set of straps (3) arranged in multiple horizontal rows along the foam back plate attached only to the left and right sides of the foam back plate, the second set of straps configured to hold additional chairs and/or other selected equipment or to further secure the chairs and/or other selected equipment held within the first set of straps;

a plurality of footie pockets (5) arranged in two rows at the bottom of the foam back plate, the footie pockets configured to support the chairs and/or other equipment;

one or more footie pocket support straps (17,18,19) extending between said plurality of footie pockets and the foam back plate, the footie pocket support straps configured to prevent downward movement of the footie pockets;

and a shoulder harness for securing the backpack to a user's back.

2. The backpack of claim 1, wherein the first set of straps (2) includes four rows of straps attached to the foam back plate.

3. The backpack of claim 1, wherein the first and second set of straps (2,3) each includes hook and loop fasteners.

4. The backpack of claim 1, wherein the plurality of footie pockets (5) includes five footie pockets.

5. The backpack of claim 4, wherein the plurality of footie pockets (5) includes a first set of three footie pockets attached to the foam back plate and two additional footie pockets attached to the first set of three footie pockets.

6. The backpack of claim 1, further comprising a handle (1) attached to said top of the foam back plate.

* * * * *